US006021755A

United States Patent [19]

Maddock et al.

[11] Patent Number: 6,021,755

[45] Date of Patent: Feb. 8, 2000

[54] METHOD AND APPARATUS FOR DETERMINING A FUEL COMMAND FOR A FUEL SYSTEM

[75] Inventors: James B. Maddock, Washington; Fred Mehdian, Peoria; Rodrigo L. Sanchez, Edelstein, all of Ill.

[73] Assignee: Caterpillar Inc., Peoria, Ill.

[21] Appl. No.: 09/121,436

[22] Filed: Jul. 23, 1998

[51] Int. Cl.[7] ..... F02D 41/00

[52] U.S. Cl. ..... 123/361; 123/480; 701/104

[58] Field of Search ..... 123/352, 478, 123/480, 361; 701/104

[56] References Cited

U.S. PATENT DOCUMENTS

| | | | |
|---|---|---|---|
| 4,047,507 | 9/1977 | Noguchi et al. | 123/352 |
| 4,914,597 | 4/1990 | Moncelle et al. | 364/426.04 |
| 5,019,986 | 5/1991 | Londt et al. | 364/426.04 |
| 5,191,867 | 3/1993 | Glassey | 123/446 |
| 5,357,912 | 10/1994 | Barnes et al. | 123/357 |
| 5,375,577 | 12/1994 | Betts, Jr. et al. | 123/480 |
| 5,445,128 | 8/1995 | Letang et al. | 123/436 |
| 5,447,031 | 9/1995 | Betts et al. | 60/603 |
| 5,480,364 | 1/1996 | Hilbert et al. | 477/107 |
| 5,611,751 | 3/1997 | Ehrenhardt et al. | 477/73 |
| 5,738,070 | 4/1998 | Donaldson et al. | 123/352 |
| 5,832,896 | 11/1998 | Phipps | 123/361 |

*Primary Examiner*—Erick R. Solis
*Attorney, Agent, or Firm*—W. Bryan McPherson, III

[57] ABSTRACT

The present invention provides a method and apparatus for determining a fuel command for an fuel system. The present invention provides a method for determining a fuel command for an engine. The method includes determining a desired and actual engine speed, comparing the desired and actual engine speeds, and controlling the air/fuel mixture flow into the intake manifold of the fuel system in response to the comparison. The inlet pressure and temperature within the manifold are then determined. A fuel command is determined in response to the manifold air pressure and temperature. The fuel command is then modified in response to the comparison of the desired and actual engine speeds.

6 Claims, 3 Drawing Sheets

METHOD AND APPARATUS FOR DETERMINING A FUEL COMMAND FOR A FUEL SYSTEM

TECHNICAL FIELD

This invention relates generally to a fuel system, and more particularly, to a method and apparatus for determining a fuel command for a fuel system.

BACKGROUND ART

Present natural gas engine systems may experience instability in the engine speed which is due to the manner in which the fuel command for the engine is calculated. A fuel command for a natural gas engine may be determined based on several engine parameters including, desired and actual engine speed, inlet manifold pressure, and manifold temperature. Depending on the sequence of events, or calculations, there may be a significant delay between the time the desired and actual engine speeds are sensed, and the time the fuel system responds to the difference between the actual and desired engine speeds. The delay is due in part to the calculation of a throttle command for controlling the position of the throttle, and then measuring the resulting manifold pressure and temperature. A change in throttle position will result in a change in the volume of the air/fuel mixture that is delivered to the manifold, which in turn results in a change in the inlet manifold pressure and temperature. However, the inlet manifold pressure and temperature do not instantaneously reach a steady state value in response to a change in the throttle command. Therefore, the fuel command calculated does not adequately account for the desired and actual engine speeds, resulting in engine speed oscillations of 10–15 r.p.m., at low frequencies, which eventually results in engine instability.

The present invention is directed to overcoming one or more of the problems set forth above.

DISCLOSURE OF THE INVENTION

In one aspect of the present invention, a method for determining a fuel command for an fuel system is disclosed. The method includes the steps of comparing a desired and actual engine speed, controlling an air/fuel mixture flow into an intake manifold located within the fuel system in response to said comparison, determining a fuel command in response to the inlet manifold pressure, manifold temperature, and actual engine speed, and modifying said fuel command in response to said engine speed comparison.

In another aspect of the present invention, an apparatus for determining a fuel command for a fuel system is disclosed. The apparatus includes, a manifold pressure sensing means for determining an inlet manifold pressure and responsively producing a pressure signal, a manifold temperature sensing means for determining a manifold temperature and responsively producing a temperature signal, and a controller for receiving a desired and actual engine speed signals, and the inlet manifold pressure and temperature signals, delivering a throttle position command to the throttle actuator in response to a comparison between the desired and actual engine speeds, determining a fuel command in response to said inlet manifold pressure, said temperature, and modifying said fuel command in response to the comparison between said desired and actual engine speeds, and responsively delivering said modified fuel command to the fuel control valve actuator.

BEST MODE FOR CARRYING OUT THE INVENTION

Figure 1:
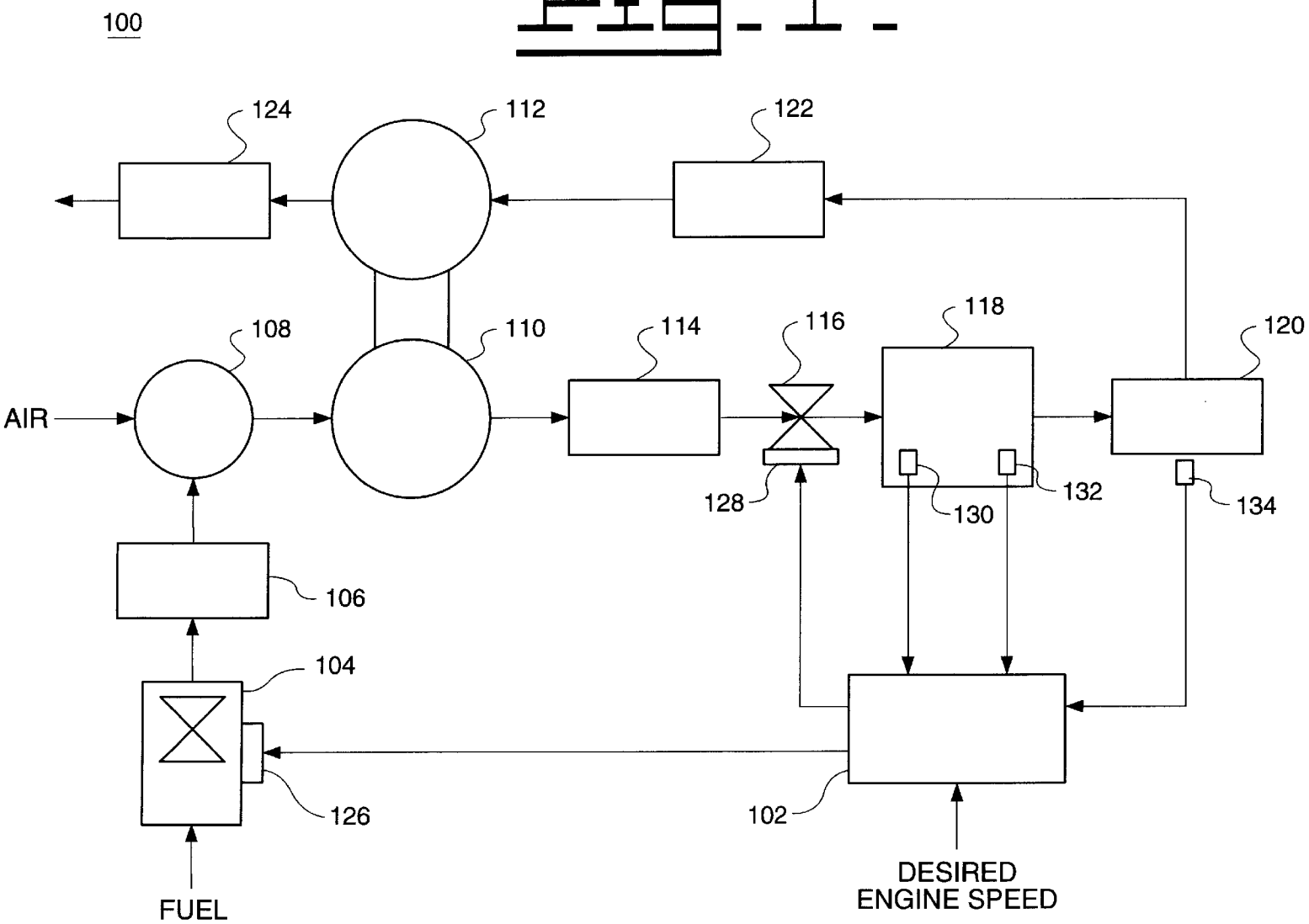
FIG. 1 is a high level diagram of one embodiment of an fuel system.

The present invention provides a method and apparatus for determining a fuel command for a fuel system. FIG. 1 is an illustration of one embodiment of an fuel system 100. A fuel control valve 104, such as a TechJet, enables fuel to flow to a air/fuel mixer 108. The air/fuel mixture passes through a turbo compressor 110 and after cooler 114. A throttle 116 controls the volume of air/fuel mixture that flows into an intake manifold 118. The manifold 118 delivers the fuel to one or more cylinders 120. The exhaust from the cylinders 120 passes through the exhaust manifold 122, the turbo turbine 112, and the exhaust stack 124.

A controller 102 receives inputs from a pressure sensor 130, located in the manifold 118, a temperature sensor 132, located in the manifold 118, an actual speed sensor 134, and a desired engine speed sensor 136. The controller 102 may receive continuous updates from the sensors. The controller 102 responsively determines a throttle position and a fuel control valve position, and sends the appropriate commands to a throttle actuator 124, and a fuel actuator 126 respectively.

The actual engine speed sensor 134 is electrically connected to the controller 102. The speed sensor 132 can be any type of sensor that accurately produces an electrical signal in response to engine crankshaft speed. For example, in one embodiment, the speed sensor 132 is mounted on an engine flywheel housing (not shown) and produces a digital speed signal in response to the speed of the flywheel mounted on an engine crankshaft (not shown). The desired engine speed may be produced by manual inputs to an engine speed throttle (not shown), or by a cruise control system (not shown).

A pressure sensor 130 is disposed in the intake manifold 118 and is electrically connected to the controller 102. The pressure sensor 130 produces a pressure signal in response to the actual absolute pressure in the intake manifold 118.

A manifold temperature sensor 132 is disposed in the intake manifold 118, and is electronically connected to the controller 102. The temperature sensor 132 produces a temperature signal in response to the temperature in the air intake manifold 118.

The controller 102 determines a throttle position command, and delivers the command to a throttle actuator 128. The throttle actuator 128 will control the position of the throttle 116 in response to the throttle command.

The controller 102 also determines a fuel command, and delivers a fuel control valve position command to a fuel valve actuator 126. The fuel valve actuator 126 will control the position of the fuel control valve 104 in response to the fuel command.

Figure 2:
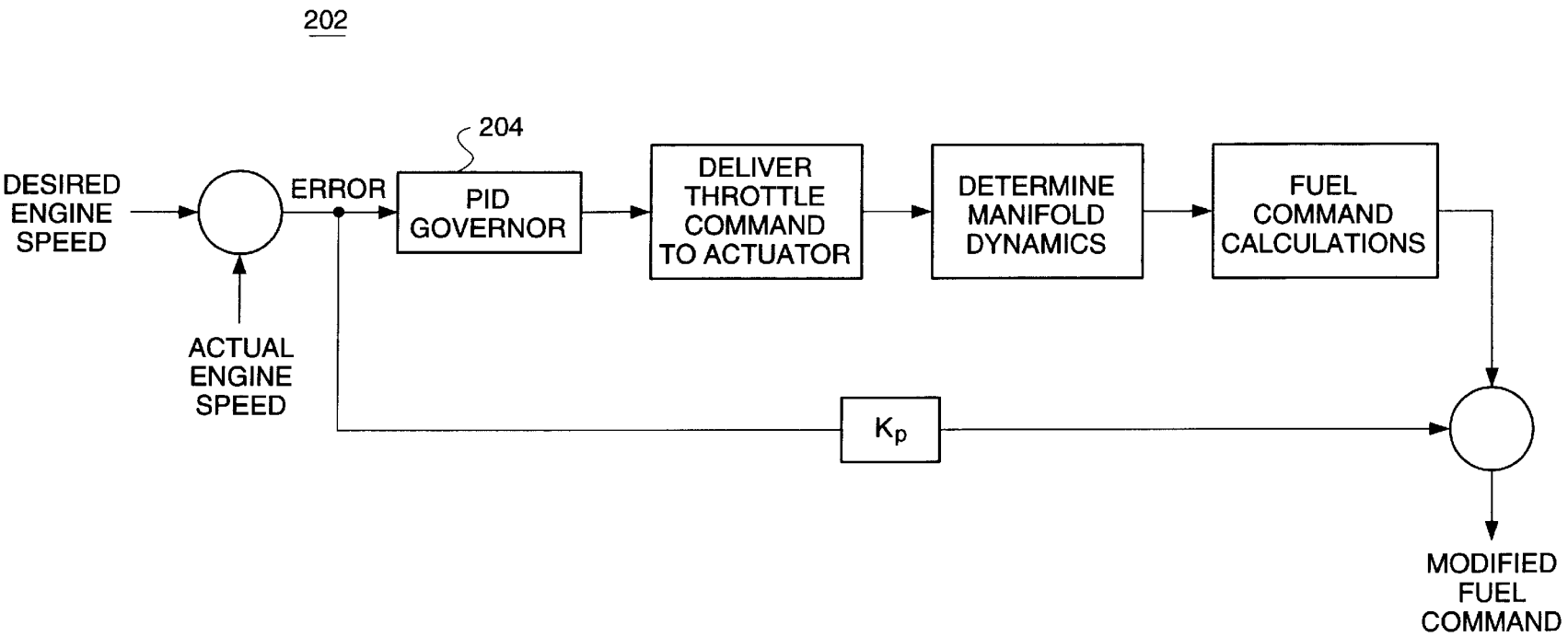
FIG. 2 is a block diagram of an electronic governor system.

In the preferred embodiment, the controller 102 includes an electronic governor system 202. FIG. 2 illustrates one embodiment of an electronic governor system 202. The quantity of fuel to be delivered to the fuel cylinders 120, is determined by the electronic governor system 202. The operation of the electronic governor system 202 is described below.

Figure 3:
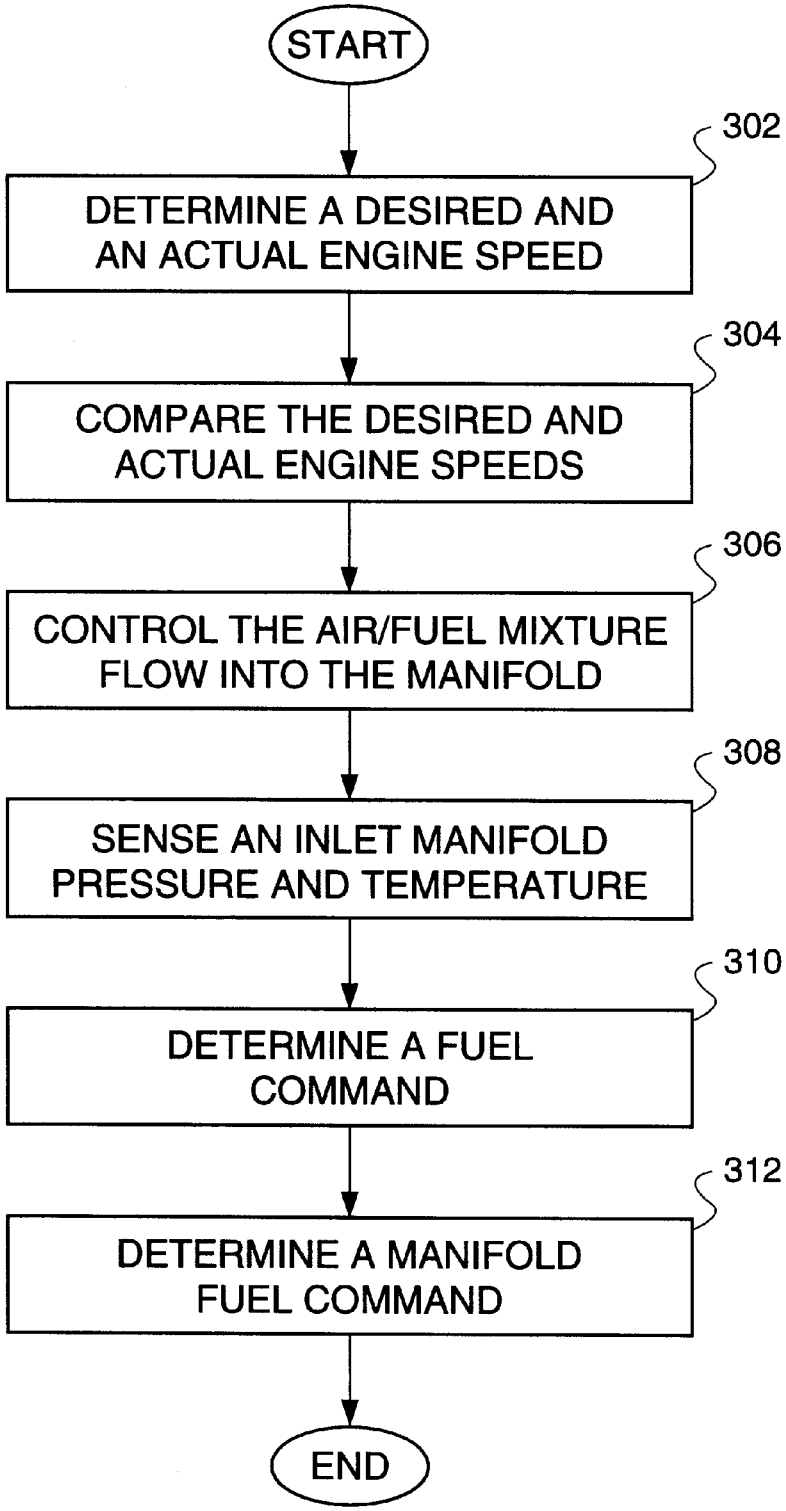
FIG. 3 is an illustration of the method for determining a modified fuel command.

FIG. 3 illustrates the preferred embodiment of the method of the present invention. The present invention includes a method for determining a fuel command for an fuel system 100, including the steps of determining a desired and actual engine speed, comparing the desired and actual engine speeds, controlling the air/fuel mixture flow into an intake manifold located within the fuel system in response to the comparison, sensing a pressure and temperature within the manifold, determining a fuel command in response to the inlet manifold pressure, manifold temperature, and actual engine speed, and then modifying the fuel command in response to the comparison between the actual and desired engine speeds.

In a first control block 302, a desired engine speed is sensed and a actual engine speed is sensed. In a second control block 304, the desired engine speed is compared to the actual engine speed. In the preferred embodiment, the difference between the desired and actual engine speed is determined, i.e., an engine speed error is determined. In a third control block 306, the air/fuel mixture flow into the manifold 118 is controlled in response to the comparison of the desired and actual engine speeds. In the preferred embodiment, a throttle position command is determined in response to the comparison between the desired and actual engine speed. The result of the comparison between the desired and actual engine speed, e.g., the engine speed error, is delivered to a PID (proportional, integral, derivative) control algorithm 204. The PID control algorithm 204 then determines a throttle command. PID control algorithms are well known in the art. An example of a PID control algorithm is shown below.

$$C_i = K_p e_i + K_I \sum_{j=0}^{i} e_j = K_D(e_i - e_{i-1})$$

Where $e_j$=error(desired speed−actual speed)

$C_I$=Command (Throttle) at time $t_i$ $K_P$=Proportional gain of the governor $K_I$=Integral gain of the governor $K_D$=Derivative gain of the governor The throttle command produced by the PID control algorithm 204 is delivered to the throttle actuator 128. The throttle actuator 128 will then responsively control the position of the throttle 116 thereby enabling the appropriate amount of air/fuel mixture into the manifold 118. Therefore, the air/fuel mixture flow into the manifold 118 is controlled in response to the comparison between the desired and actual engine speeds.

In a fourth control block 308, the inlet manifold pressure and manifold temperature are sensed and delivered to the controller 102. The inlet manifold pressure and temperature are affected, in part, by the volume of the air/fuel mixture that is being delivered into the manifold 116. The volume of air/fuel mixture delivered to the manifold is effected by the throttle position. Therefore the inlet manifold pressure and temperature are effected by a change in the throttle position. However, the inlet manifold pressure and temperature do not change instantaneously in response to the change in throttle position. There is a delay, or lag, between the time the throttle position is determined and changed, and the time the inlet manifold pressure and temperature reach a steady state value. Therefore, calculations that are based on the inlet manifold pressure and temperature are based on data that may be changing in response to the throttle command.

In a fifth control block 310, the controller 102 determines a fuel command to control the amount of fuel that is mixed with the air in the mixer 108. The fuel command is determined in response to the inlet manifold pressure, manifold temperature, and actual engine speed. In the preferred embodiment, the fuel command is determined by first determining the amount of air flow into the manifold 118. The air flow is determined based upon the actual engine speed, inlet manifold pressure, and manifold temperature. Determining air flow based upon engine speed, inlet manifold pressure and temperature, is well known in the art. The air flow is then divided by the appropriate air/fuel ratio to determine the fuel command. The appropriate air/fuel ratio is determined using an air/fuel ratio map. The actual engine speed and the manifold pressure are used as inputs to the air/fuel ratio map to determine the appropriate air/fuel ratio. The air/fuel ratio map is created based upon empirical testing, simulation, and analysis to determine the appropriate air/fuel ratio for a given engine speed and inlet manifold pressure.

Therefore, the amount of air flow into the intake manifold 118 is used in conjunction with an air/fuel ratio map, to determine the amount of fuel needed to be mixed with the air, i.e., the fuel command. In the preferred embodiment the fuel command is determined by dividing the air flow by the air/fuel ratio.

Therefore, the fuel command is determined, indirectly, in response to the comparison of the desired and actual engine speeds. The comparison of the desired and actual engine speeds, effects the throttle position, which effects the inlet manifold pressure and temperature. However, when the fuel command is calculated, the inlet manifold pressure and temperature have probably not reached a steady state value in response to a change in the throttle position, i.e., the change in the volume of air/fuel mixture delivered to the manifold 118. Therefore, while the fuel command is calculated in a timely manner, the fuel command may not adequately account for the engine speed error associated with the comparison of the desired and actual engine speeds. The fact that the fuel command does not adequately account for the desired and actual engine speeds may result in instability in the engine speed because the fuel command is reacting to data that has not reached a steady state. Therefore, in a sixth control block 312, the fuel command is modified to directly account for the comparison between the desired and actual engine speed. In the preferred embodiment, the difference between the actual engine speed and the desired engine speed, that was delivered to the PID control algorithm 204, is multiplied by a proportional gain factor resulting in a modified engine speed error factor. The proportional gain factor may be determined by empirical testing, and will vary for different fuel systems. The resulting modified engine speed error factor may be added to the fuel command, resulting in a modified fuel command that directly accounts for the difference between the desired and actual engine speed. The modified fuel command is then delivered to the fuel valve actuator 126. The fuel valve actuator 126 then responsively controls the position of the fuel control valve 104 to enable the appropriate amount of fuel to be mixed with air for delivery to the manifold 118.

In an alternative embodiment, the proportional gain factor may include an integral term.

INDUSTRIAL APPLICABILITY

The present invention provides a method and apparatus for determining a fuel command for an fuel system. The method includes determining a desired and actual engine speed, comparing the desired and actual engine speeds, and controlling the air/fuel mixture flow into the intake manifold in response to the comparison. The inlet pressure and temperature within the manifold are then sensed. A fuel command is determined in response to the inlet manifold pressure and temperature. The fuel command is then modified in response to the comparison of the desired and actual engine speeds.

In the preferred embodiment, the desired and actual engine speeds are sensed. The throttle position, controlling the volume of air/fuel mixture flow into the manifold, is modified in response to the difference between the desired and actual engine speeds. The air flow through the manifold is then determined by sensing the manifold air pressure and temperature. A fuel command is determined based upon the air flow through the manifold and an air fuel ratio, which is based on the manifold pressure and actual engine speed. The manifold pressure and temperature do not change instantaneously when the throttle position changes. Therefore, the fuel command may be calculated based upon parameters that have not reached a steady state value. The fuel command is modified by adding the difference between the desired and actual engine speeds to the fuel command to account for the fact that the manifold air pressure and temperature have not reached steady state values. In one embodiment, the difference in engine speeds is multiplied by a proportional gain factor prior to adding it to the fuel command. The modified fuel command will reduce or eliminate engine speed oscillations that are attributed to the lag between the time the throttle position changes, and the time the manifold pressure and temperature reach a steady state value.

Other aspects, objects, and advantages of the present invention can be obtained from a study of the drawings, the disclosure, and the claims.

What is claimed is:

1. A method for determining a fuel command for an fuel system comprising the steps of:

determining a desired and actual engine speed;

comparing said desired and actual engine speed;

controlling an air/fuel mixture flow into an intake manifold located within the fuel system in response to said comparison;

determining an inlet pressure and temperature of said manifold;

determining a fuel command in response to said inlet manifold pressure, said manifold temperature, and said actual engine speed; and modifying said fuel command in response to said engine speed comparison.

2. A method, as set forth in claim 1, wherein the step of determining said fuel command further comprises the steps of:

determining an air flow in said intake manifold of said engine in response to said actual engine speed, said inlet manifold pressure, and said manifold temperature;

determining an air fuel ratio in response to said actual engine speed and said manifold pressure; and determining said fuel command in response to said air flow and said air fuel ratio.

3. A method, as set forth in claim 2, wherein the step of comparing said desired and said actual engine speed further comprises the steps of:

determining an error between said desired and said actual engine speeds; and modifying said fuel command in response to said error.

4. A method, as set forth in claim 3, wherein the step of modifying said fuel command further comprises the steps of:

modifying said error in response to an proportional gain factor; and modifying said fuel command in response to said modified error.

5. An apparatus for determining a fuel command for an fuel system, the fuel system having a fuel control valve for controlling a volume of fuel to be mixed with air, and a throttle for controlling the volume of air/fuel mixture delivered to an intake manifold located within the fuel system, said fuel control valve being connected to and controlled by a fuel valve actuator, said throttle being connected to and controlled by a throttle actuator, comprising:

an actual speed sensing means for sensing an actual speed of an the engine and responsively producing an actual speed signal;

a desired speed sensing means for determining a desired speed of the engine and responsively producing a desired speed signal;

an inlet manifold pressure sensing means for determining an inlet manifold pressure and responsively producing a pressure signal;

a manifold temperature sensing means for determining a manifold temperature and responsively producing a temperature signal; and a controller for receiving said desired and actual engine speed signals, and said inlet manifold pressure and temperature signals, delivering a throttle position command to said throttle actuator in response to the difference between said desired and actual engine speeds, determining a fuel command in response to said inlet manifold pressure, said temperature, and said actual engine speed, and modifying said fuel command in response to the difference between said desired and actual engine speeds, and responsively delivering said modified fuel command to said fuel control valve actuator.

6. An apparatus as set forth in claim 5, wherein said controller further comprises:

a means for determining an air flow in said manifold in response to said manifold air pressure and temperature; and an air/fuel ratio mapping means for determining an air/fuel ratio of said manifold in response to said manifold air pressure and actual engine speed;

wherein said fuel command is determined in response to said air flow and said air/fuel ratio.

* * * * *